US011350495B2

(12) United States Patent
Chen et al.

(10) Patent No.: US 11,350,495 B2
(45) Date of Patent: May 31, 2022

(54) LED DRIVER WITH SILICON CONTROLLED DIMMER, APPARATUS AND CONTROL METHOD THEREOF

(71) Applicant: Silergy Semiconductor Technology (Hangzhou) LTD, Hangzhou (CN)

(72) Inventors: Huiqiang Chen, Hangzhou (CN); Zhishuo Wang, Hangzhou (CN); Jianxin Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 16/407,382

(22) Filed: May 9, 2019

(65) Prior Publication Data

US 2019/0364628 A1 Nov. 28, 2019

(30) Foreign Application Priority Data

May 25, 2018 (CN) ..... 201810513386.4

(51) Int. Cl.

| | |
|---|---|
| ***H05B 45/10*** | (2020.01) |
| ***H05B 45/31*** | (2020.01) |
| ***H05B 45/3575*** | (2020.01) |
| ***H05B 45/395*** | (2020.01) |

(52) U.S. Cl.

CPC ..... *H05B 45/10* (2020.01); *H05B 45/31* (2020.01); *H05B 45/3575* (2020.01); *H05B 45/395* (2020.01)

(58) Field of Classification Search

CPC ..... H05B 33/0815; H05B 33/0845; H05B 33/0809; H05B 33/083; H05B 33/0824; H05B 33/0851; H05B 33/0818; H05B 37/02; H05B 33/0848; H05B 33/0887

See application file for complete search history.

(56) References Cited

U.S. PATENT DOCUMENTS

| | | | | |
|---|---|---|---|---|
| 8,581,518 | B2 | 11/2013 | Kuang et al. | |
| 2010/0164403 | A1* | 7/2010 | Liu | H05B 45/347 315/297 |
| 2011/0127925 | A1 | 6/2011 | Huang et al. | |
| 2013/0169177 | A1* | 7/2013 | Liao | H05B 45/375 315/200 R |
| 2014/0159616 | A1* | 6/2014 | Wang | H05B 33/0848 315/307 |
| 2014/0333228 | A1* | 11/2014 | Angeles | H05B 33/0815 315/291 |
| 2016/0081151 | A1* | 3/2016 | Wang | H05B 45/37 315/186 |
| 2017/0055323 | A1* | 2/2017 | Lim | H05B 47/16 |
| 2017/0196062 | A1* | 7/2017 | Wang | H05B 45/3725 |
| 2017/0318639 | A1 | 11/2017 | Wang et al. | |

(Continued)

OTHER PUBLICATIONS

Title: SCR Phase Control Speed Control Dimmer, Author: Jim Keith, pp. 1-12.*

*Primary Examiner* — Wei (Victor) Y Chan

(57) ABSTRACT

An apparatus for an LED driver with a silicon-controlled dimmer, can include: a bleeder circuit coupled to a DC bus of the LED driver; and a controller configured to control the bleeder circuit to draw a bleeder current from the DC bus when a conduction angle of the silicon-controlled dimmer is less than an angle threshold, in order to maintain a conduction state of the silicon-controlled dimmer.

19 Claims, 4 Drawing Sheets

(56) References Cited

U.S. PATENT DOCUMENTS

| | | | | |
|---|---|---|---|---|
| 2018/0139816 | A1* | 5/2018 | Liu | H05B 45/10 |
| 2018/0295685 | A1 | 10/2018 | Wang et al. | |
| 2018/0295690 | A1 | 10/2018 | Chen et al. | |
| 2018/0310376 | A1 | 10/2018 | Huang et al. | |

* cited by examiner

LED DRIVER WITH SILICON CONTROLLED DIMMER, APPARATUS AND CONTROL METHOD THEREOF

RELATED APPLICATIONS

This application claims the benefit of Chinese Patent Application No. 201810513386.4, filed on May 25, 2018, which is incorporated herein by reference in its entirety.

FIELD OF THE INVENTION

The present invention generally relates to the field of power electronics, and more particularly to LED drivers with silicon-controlled dimmers, along with associated apparatuses and methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

For a light-emitting diode (LED) lighting system with a silicon-controlled dimmer, a holding current is the minimum current required to maintain the silicon-controlled dimmer in an on state. To facilitate this holding current, a bleeder circuit may be included in an LED driver with a silicon-controlled dimmer. The bleeder circuit may provide an extra bleeder current to the silicon-controlled dimmer in order to maintain conduction of the silicon-controlled dimmer.

When the conduction angle of the silicon-controlled dimmer is relatively small, an input current of the LED driver that is provided to the silicon-controlled dimmer may be lower than the holding current of the silicon-controlled dimmer, causing the silicon-controlled dimmer to turn off. The waveform of an input voltage of the LED driver may be asymmetric, causing light source to repeatedly spike, thereby affecting compatibility of the silicon-controlled dimmer. When the conduction angle of the silicon-controlled dimmer is less than a threshold value, the bleeder circuit may operate to provide a bleeder current to improve the compatibility of the silicon-controlled dimmer.

In one embodiment, an apparatus for an LED driver with a silicon-controlled dimmer, can include: (i) a bleeder circuit coupled to a DC bus of the LED driver; and (ii) a controller configured to control the bleeder circuit to draw a bleeder current from the DC bus when a conduction angle of the silicon-controlled dimmer is less than an angle threshold, in order to maintain a conduction state of the silicon-controlled dimmer.

Figure 1:
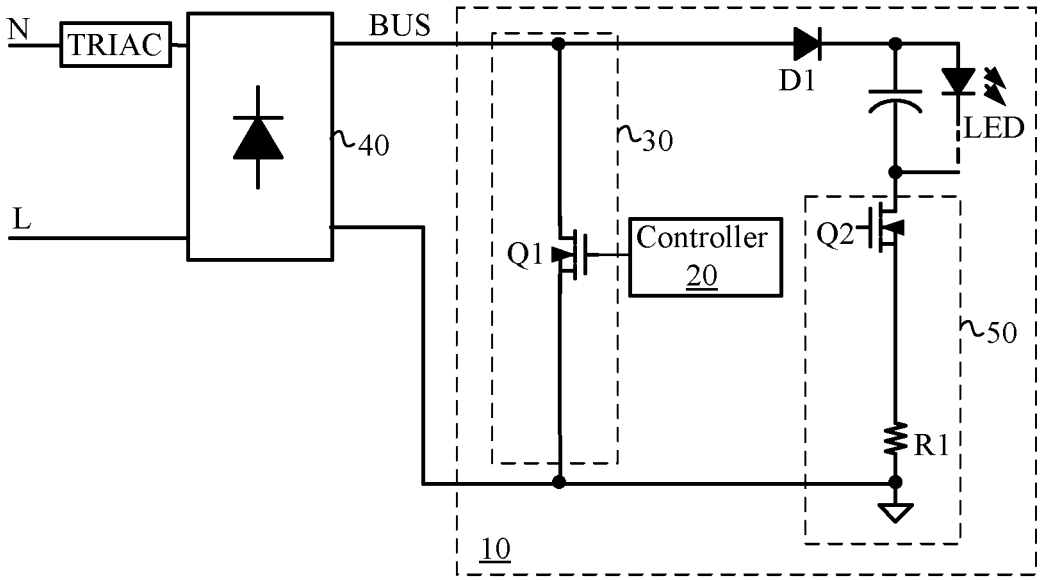
FIG. 1 is a schematic block diagram of an example LED driver, in accordance with embodiments of the present invention.

Referring now to FIG. 1, shown is a schematic block diagram of an example LED driver, in accordance with embodiments of the present invention. This LED driver can include silicon-controlled dimmer TRIAC, apparatus 10, and rectifier circuit 40. Silicon-controlled dimmer TRIAC can connect between AC input port and rectifier circuit 40. Rectifier circuit 40 can convert an AC signal chopped by silicon-controlled dimmer TRIAC to a DC signal that is provided to a DC bus (BUS). Apparatus 10 can include controller 20, bleeder circuit 30, linear regulation circuit 50, and diode D1. In some cases, diode D1 connected to the DC bus may be omitted. Bleeder circuit 30 can connect to the DC bus, and may draw a bleed current from the DC bus. Bleeder circuit 30 can include transistor Q1. In some cases, bleeder circuit 30 may further include a detecting component (e.g., a resistor) that may be connected in series with transistor Q1, and which can generate a current sampling signal representative of the bleeder current, in order to control the bleeder current.

Controller 20 can connect to bleeder circuit 30, and may control bleeder circuit 30 to operate after silicon-controlled dimmer TRIAC is turned on and when the conduction angle of silicon-controlled dimmer TRIAC is less than an angle threshold. Bleeder circuit 30 can draw a bleeder current provided to silicon-controlled dimmer TRIAC from the DC bus in order to maintain a conduction state of the silicon-controlled dimmer. In this way, the conduction time of silicon-controlled dimmer TRIAC may be lengthened, and compatibility of the silicon-controlled dimmer TRIAC can be improved. Since a holding current is the minimum current required to maintain silicon-controlled dimmer TRIAC in an on state, the bleeder current may be determined in accordance with a holding current of silicon-controlled dimmer TRIAC, and the bleeder current can be consistent with (e.g., equal to) the holding current.

Linear regulation circuit 50 can include transistor Q2 and detecting component R1. Detecting component R1 can generate a current sampling signal (VS1) representative of a drive current of the LED load, and that may be used to adjust the control voltage of transistor Q2. Linear regulation circuit 50 can be integrated with the LED load in some cases, while in other cases the LED load can also be in a separate package/device from the linear devices in the linear regulation circuit. Detecting component(s) may be resistors (e.g., R1) or other devices that can be used to sample current. In particular embodiments, an input current of the LED driver (e.g., equal to the sum of the drive current and the bleeder current) may not be less than the holding current of silicon-controlled dimmer TRIAC, in order to maintain the conduction state of silicon-controlled dimmer TRIAC.

The conduction angle (PH) of silicon-controlled dimmer TRIAC may be determined by a sampling signal (VS) generated by sampling the drive current (ILED) flowing through the LED load, and/or by sampling DC bus voltage VBUS. In addition, sampling signal VS can be compared against reference signal Vref1, in order to obtain a control voltage signal (VCF) representative of the duration that sampling signal VS is continuously greater than reference signal Vref1 in one cycle. Control voltage signal VCF may be representative of conduction angle PH of silicon-controlled dimmer TRIAC. When conduction angle PH of silicon-controlled dimmer TRIAC is detected to be a relatively large angle, or the lighting system does not have a silicon-controlled dimmer TRIAC present, bleeder circuit 30 may not operate (be disabled). When conduction angle PH is detected to be less than the angle threshold, bleeder circuit 30 can operate (be enabled) to draw the bleeder current from the DC bus. Therefore, the bleeder current can be supplemented when silicon-controlled dimmer TRIAC has a relatively small conduction angle, thereby improving compatibility and ensuring the efficiency of silicon-controlled dimmer TRIAC with a relatively large conduction angle.

Figure 2:
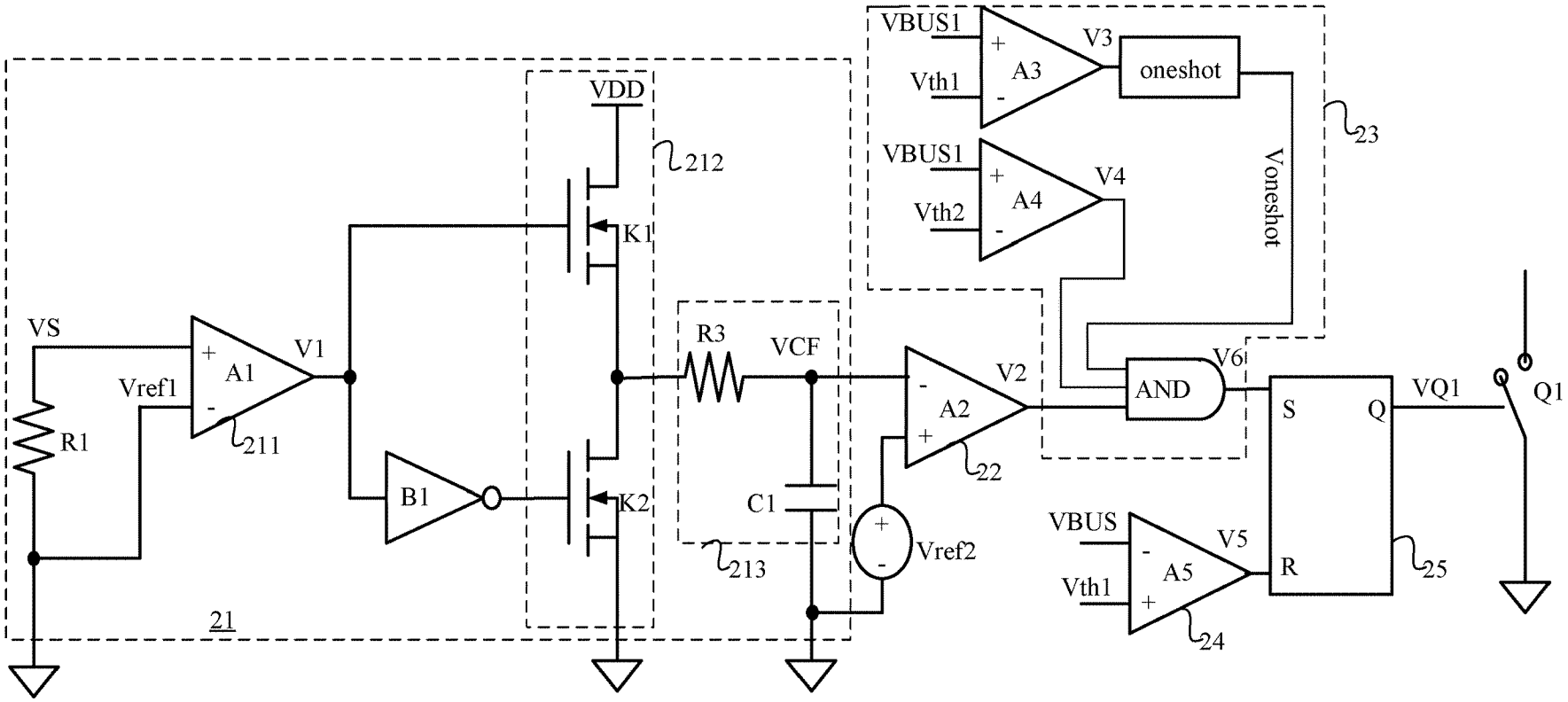
FIG. 2 is a schematic block diagram of an example control circuit, in accordance with embodiments of the present invention.

Referring now to FIG. 2, shown is schematic block diagram of an example controller, in accordance with embodiments of the present invention. In this example, controller 20 can determine conduction angle PH of silicon-controlled dimmer TRIAC by sampling signal VS generated by sampling drive current ILED flowing through the LED load. Controller 20 can include conduction angle detecting circuit 21, comparator 22, set signal generating circuit 23, reset signal generating circuit 24, and logic circuit 25. For example, conduction angle detecting circuit 21 can include comparator 211, switching circuit 212, and averaging circuit 213. A non-inverting input of comparator 211 can receive sampling signal VS, and an inverting input of comparator 211 can receive reference signal Vref1. In this particular example, reference signal Vref1 may be grounded, and an output of comparator 211 can generate comparison signal V1. In this example, comparison signal V1 can be averaged to obtain a relatively stable control voltage signal VCF. Also, control voltage signal VCF can be used to characterize conduction angle PH of silicon-controlled dimmer TRIAC.

Switching circuit 212 can include switches K1 and K2 connected in series between DC voltage VDD and ground. One end of switch K1 can connect to DC voltage VDD, and another end of switch K1 can connect to one terminal of switch K2, while another end of switch K2 can connect to ground. In this particular example, switching circuit 212 can be controlled by comparison signal V1. For example, switch K1 can be directly controlled by comparison signal V1 to be turned on/off, and switch K2 can be controlled by the inverted version of comparison signal V1 to be turned on/off. Thus, comparison signal V1 can connect to a control terminal of switch K2 through inverter B1. When comparison signal V1 is high, switch K1 may be turned on, and averaging circuit 213 can be charged by DC voltage VDD. When comparison signal V1 is low, switch K2 can be turned on, and averaging circuit 213 can be discharged to ground.

In this particular example, averaging circuit 213 can connect to a common node of switches K1 and K2, in order to generate stable control voltage signal VCF. For example, averaging circuit 213 can include resistor R2 and capacitor C1 connected in series, and control voltage signal VCF can be generated at a common node of resistor R2 and capacitor C1. With switching circuit 212 and averaging circuit 213, comparison signal V1 in pulse form can be converted into a stable control voltage signal VCF. When comparison signal V1 is high, averaging circuit 213 can be charged by DC voltage VDD, such that control voltage signal VCF can be gradually increased. When comparison signal V1 is low, averaging circuit 213 may be discharged to ground, such that control voltage signal VCF can be gradually decreased. By integrating comparison signal V1, stable control voltage signal VCF can be obtained. In this example, comparison signal V1 can be integrated by one switching circuit and one averaging circuit, in order to obtain a stable control voltage signal VCF representative of the conduction angle PH of silicon-controlled dimmer TRIAC.

Conduction angle detecting circuit 21 may also include comparator 22 that compares control voltage signal VCF against reference signal Vref2 that characterizes the angle threshold, in order to generate comparison signal V2. In this example, a non-inverting input terminal of comparator 22 can receive control voltage signal VCF, and an inverting input terminal of comparator 22 can receive reference voltage Vref2. As conduction angle PH of silicon-controlled dimmer TRIAC gradually decreases, the duration during which sampling signal VS is greater than reference signal Vref1 in one cycle may also be reduced, such that control voltage signal VCF can be gradually reduced. When control voltage signal VCF is less than reference signal Vref2, comparison signal V2 generated by comparator 22 may be high, which can indicate that conduction angle PH of silicon-controlled dimmer TRIAC is less than the angle threshold.

Set signal generating circuit 23 can determine a turn-on time of silicon-controlled dimmer TRIAC by sampling the DC bus voltage, and may include comparator A3, single trigger circuit "oneshot," comparator A4, and AND-gate "AND." Comparator A3 can compare voltage sampling signal VBUS1 representative of DC bus voltage VBUS against voltage threshold Vth1. In this example, a non-inverting input of comparator A3 can receive voltage sampling signal VBUS1, an inverting input of comparator A3 can receive voltage threshold Vth1, and an output of comparator A3 can provide comparison signal V3.

Single trigger circuit oneshot can receive comparison signal V3, and generate single trigger signal Voneshot according to comparison signal V3. For example, single trigger circuit oneshot can set comparison signal V3 to be high for a predetermined time period (e.g., about 100 ns) at the rising edge or the falling edge of comparison signal V3. Comparator A4 can compare voltage sampling signal VBUS1 representative of DC bus voltage VBUS against voltage threshold Vth2. In this example, a non-inverting input of comparator A4 can receive voltage sampling signal VBUS1, an inverting input of comparator A4 can receive voltage threshold Vth2, and an output of comparator A4 can provide comparison signal V4.

The AND-gate can also receive single trigger signal Voneshot, comparison signal V4, and comparison signal V2, and may generate set signal V6. When single trigger signal Voneshot, comparison signal V4, and comparison signal V2 are all high, set signal V6 may also be high. In this way, bleeder circuit 30 can operate after silicon-controlled dimmer TRIAC is turned on and when the conduction angle of silicon-controlled dimmer TRIAC is less than the angle threshold, such that bleeder circuit 30 can draw the bleeder current provided to the silicon-controlled dimmer TRIAC from the DC bus, in order to lengthen the conduction time of silicon-controlled dimmer TRIAC. In this way, flickering of the light source that may be caused by the asymmetric waveform when the conduction angle of silicon-controlled dimmer TRIAC is relatively small can be substantially avoided, thereby improving its compatibility.

When voltage sampling signal VBUS1 is greater than voltage threshold Vth1, comparison signal V3 generated by comparator A3 may be high, and single trigger signal Voneshot of single trigger circuit oneshot can also be high for the predetermined time period (e.g., about 100 ns). When voltage sampling signal VBUS1 is greater than voltage threshold Vth2, comparison signal V4 generated by comparator A4 can be high. At this time, if single trigger signal Voneshot, comparison signal V4, and comparison signal V2 are all high, the AND-gate may drive set signal V6 high. Comparison signal V3 may be set to be a high level for a short time period by single trigger circuit oneshot, and then logically AND'ed with comparison signal V4 generated by comparator A4 to generate the set signal for detecting whether silicon-controlled dimmer TRIAC is turned on.

Reset signal generating circuit 24 can include comparator A5 for comparing voltage sampling signal VBUS1 representative of DC bus voltage VBUS against voltage threshold Vth1. In this example, an inverting input of comparator A5 can receive voltage sampling signal VBUS1, a non-inverting input of comparator A5 can receive voltage threshold Vth1, and an output terminal of comparator A5 may provide reset signal V5. When voltage sampling signal VBUS1 is decreased to be less than voltage threshold Vth1, comparison signal V5 generated by comparator A5 can be high. Logic circuit 25 can include an SR flip-flop for generating control signal VQ1 of bleeder circuit 30 according to set signal V6 and reset signal V5. The set terminal of the SR flip-flop can receive set signal V6, the reset terminal of the SR flip-flop can receive reset signal V5, and the output of the SR flip-flop can generate control signal VQ1.

Figure 3:
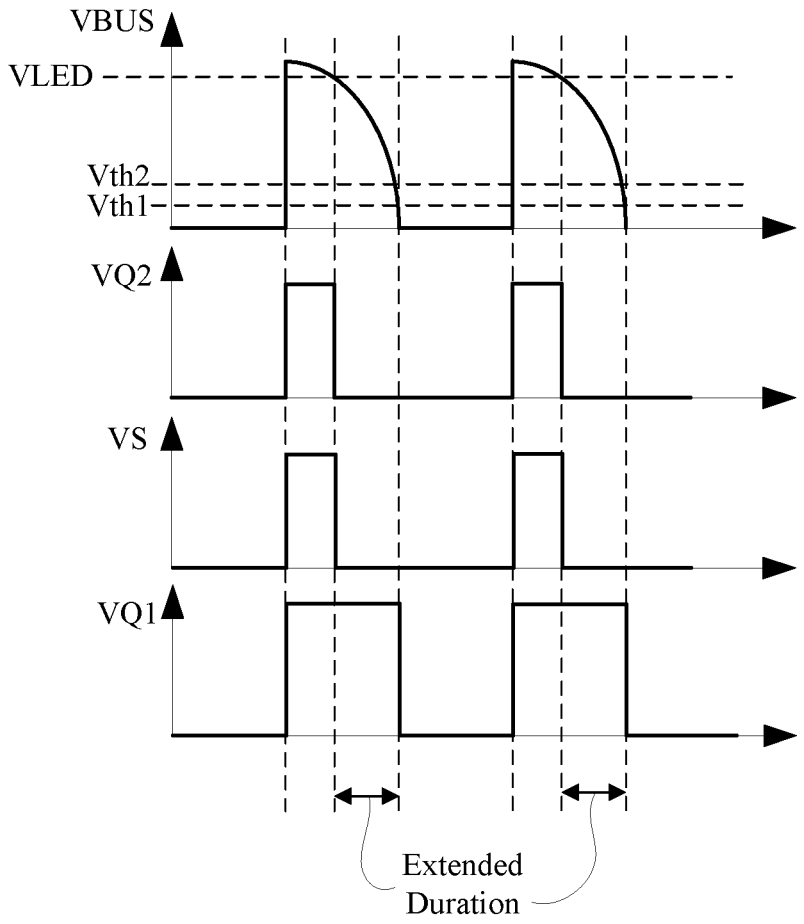
FIG. 3 is a waveform diagram of an example operation of the LED driver, in accordance with embodiments of the present invention.

Referring now to FIG. 3, shown is a waveform diagram of an example operation of the LED driver, in accordance with embodiments of the present invention. In particular embodiments, control signal VQ1 of bleeder circuit 30 can be high when silicon-controlled dimmer TRIAC is turned on and conduction angle PH of silicon-controlled dimmer TRIAC is less than the angle threshold, in order to control transistor Q1 to turn on and draw the bleeder current from the DC bus. When DC bus voltage VBUS falls to a relatively small value, transistor Q1 can be turned off, thereby cutting off the bleeder current.

Thus, when conduction angle PH of silicon-controlled dimmer TRIAC is less than the angle threshold, bleeder current can be generated from a time instant that silicon-controlled dimmer TRIAC is turned on to a time instant that the DC bus voltage is decreased to voltage threshold Vth1 (e.g., while control signal VQ1 is high). In this way, the silicon-controlled dimmer TRIAC can lengthen the conduction time, in order to maintain DC bus voltage VBUS as consistent with the AC signal, thereby substantially avoiding an asymmetric waveform of DC bus voltage VBUS and flickering of the light source. In this example, voltage threshold Vth1 may be less than drive voltage VLED of the LED load.

Figure 4:
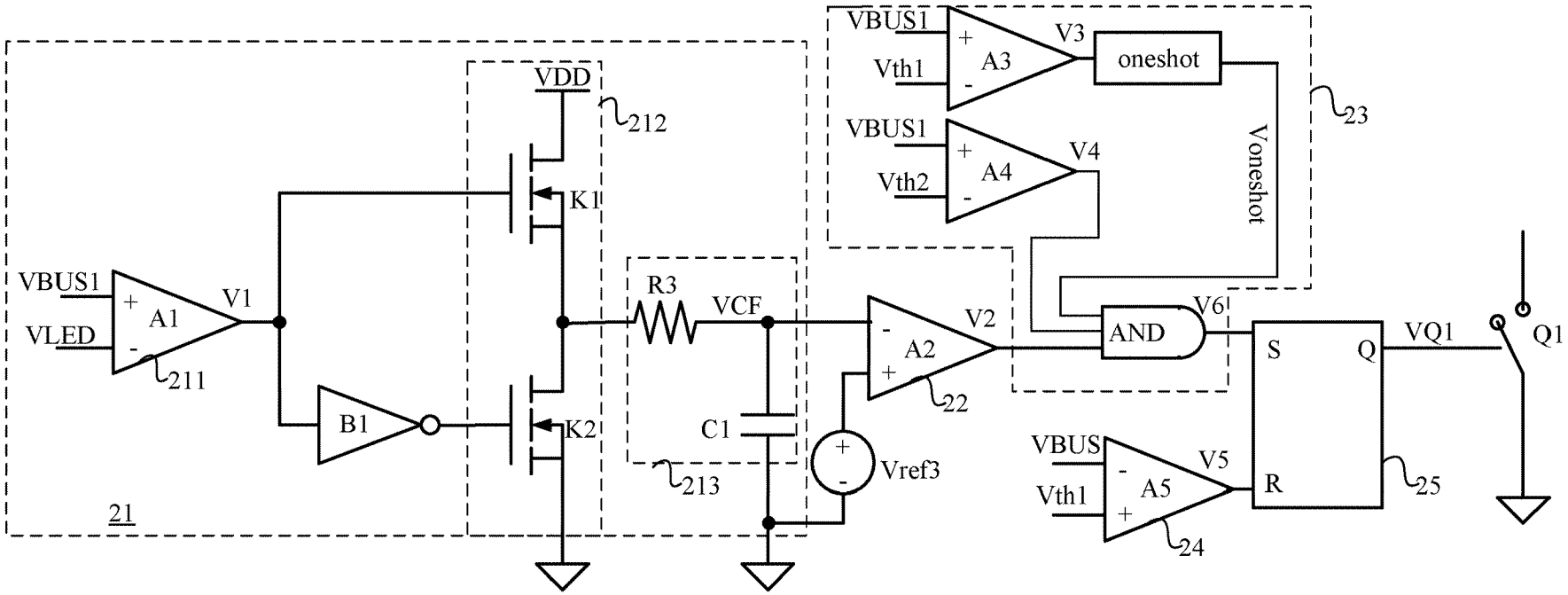
FIG. 4 is a schematic block diagram of another example control circuit, in accordance with embodiments of the present invention.

Referring now to FIG. 4, shown is schematic block diagram of another example controller, in accordance with embodiments of the present invention. In this particular example, voltage sampling signal VBUS1 can be obtained by sampling DC bus voltage VBUS, and voltage sampling signal VBUS1 can be used in place of sampling signal VS of FIG. 2. Because the sampling parameter is changed in this example, reference signal Vref1 compared against it may also be changed accordingly. Here, driving voltage VLED of the LED load can be used in place of reference signal Vref1. Further, reference signal Vref2 representative of the angle threshold for comparison against control voltage signal VCF may also be changed accordingly. Here, voltage Vref3 can be used in place of reference signal Vref2.

In particular embodiments, bleeder circuit 30 can operate after silicon-controlled dimmer TRIAC is turned on and when the conduction angle of silicon-controlled dimmer TRIAC is less than an angle threshold. As such, the bleeder circuit can draw the bleeder current provided to the silicon-controlled dimmer TRIAC from the DC bus to lengthen the conduction time of silicon-controlled dimmer TRIAC. This can substantially avoid flickering of the light source that may be caused by the asymmetric waveform when the conduction angle of silicon-controlled dimmer TRIAC is relatively small, thereby improving silicon-controlled dimmer TRIAC compatibility.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. An apparatus for a light-emitting diode (LED) driver with a silicon-controlled dimmer, the apparatus comprising:

a) a bleeder circuit coupled to a DC bus of said LED driver, wherein said LED driver comprises an output capacitor coupled in parallel with said LED load and having a first common node coupled to said DC bus and a second common node directly connected to a power terminal of a main transistor, wherein a DC bus voltage of said DC bus has a half-sinusoidal waveform; and b) a controller configured to detect a conduction angle of said silicon-controlled dimmer, to control said bleeder circuit to supplement a bleeder current being drawn from said DC bus after said main transistor is converted to be off from an on state, and to control said bleeder circuit not to operate when said conduction angle is greater than an angle threshold, or when said LED driver does not have silicon-controlled dimmer, in order to maintain a conduction state of said silicon-controlled dimmer by extending a duration of said bleeder current being drawn from said DC bus, wherein said controller is configured to supplement said bleeder current by comparing a sampling signal representative of a drive current flowing through said LED load against a reference ground, or by comparing a sampling signal representative of said DC bus voltage against a driving voltage of said LED load.

2. The apparatus of claim 1, wherein said bleeder circuit is controlled to supplement said bleeder current when said conduction angle of said silicon-controlled dimmer is less than an angle threshold and after said silicon-controlled dimmer is turned on, such that an input current of said LED driver is controlled to be not less than a holding current of said silicon-controlled dimmer.

3. The apparatus of claim 1, wherein a moment that said bleeder current begins to be drawn from said DC bus is not earlier than a moment that said main transistor is converted to be on from an off state, and an ending moment of said bleeder current is later than a moment that said main transistor is converted to be off from an on state.

4. The apparatus of claim 1, wherein a value of said bleeder current is determined in accordance with a holding current of said silicon-controlled dimmer to maintain an input current of said LED driver to be not less than a holding current of said silicon-controlled dimmer.

5. The apparatus of claim 1, wherein said bleeder current is further supplemented when said drive current of said LED load is less than a holding current of said silicon-controlled dimmer.

6. The apparatus of claim 2, wherein said controller comprises a conduction angle detecting circuit configured to generate a control voltage signal representative of said conduction angle of said silicon-controlled dimmer in accordance with one of said DC bus voltage and said drive current of said LED load.

7. The apparatus of claim 1, wherein said controller comprises a set signal generating circuit configured to determine a turn-on time of said silicon-controlled dimmer in accordance with said DC bus voltage.

8. The apparatus of claim 1, wherein said controller comprises a reset signal generating circuit configured to generate a reset signal to control said bleeder circuit to stop generating said bleeder current.

9. The apparatus of claim 1, further comprising a rectifier circuit coupled to said silicon-controlled dimmer, and being configured to generate said DC bus voltage, wherein said silicon-controlled dimmer is coupled to an AC input source.

10. A method of controlling a light-emitting diode (LED) driver with a silicon-controlled dimmer, the method comprising:

a) detecting a conduction angle of said silicon-controlled dimmer;

b) supplementing, by a bleeder circuit, a bleeder current being drawn from said DC bus after a main transistor of said LED driver is converted to be off from an on state and said silicon-controlled is dimmer is turned on in order to maintain a conduction state of said silicon-controlled dimmer by extending a duration of said bleeder current being drawn from said DC bus, wherein said supplementing said bleeder current comprises comparing a sampling signal representative of a drive current flowing through an LED load against a reference ground, or comparing a sampling signal representative of a DC bus voltage against a driving voltage of said LED load;

c) controlling said bleeder circuit not to operate when said conduction angle is greater than an angle threshold, or when said LED driver does not have silicon-controlled dimmer; and d) wherein said LED driver comprises an output capacitor coupled in parallel with said LED load and having a first common node coupled to said DC bus and a second common node directly connected to a power terminal of said main transistor, and wherein said DC bus voltage has a half-sinusoidal waveform.

11. The method of claim 10, wherein said bleeder current is generated when said conduction angle of said silicon-controlled dimmer is less than an angle threshold and after said silicon-controlled dimmer is turned on, in order to maintain an input current of said LED driver to be greater than a holding current of said silicon-controlled dimmer.

12. The method of claim 10, wherein a moment that said bleeder current begins to be drawn from said DC bus is not earlier than a moment that said main transistor is converted to be on from an off state, and an ending moment of said bleeder current is later than a moment that said main transistor is converted to be off from an on state.

13. The method of claim 10, wherein a value of said bleeder current is determined in accordance with a holding current of said silicon-controlled dimmer to maintain an input current of said LED driver to be not less than a holding current of said silicon-controlled dimmer.

14. The method of claim 10, wherein said bleeder current is controlled to end before a moment that said DC bus voltage decreases to a first voltage threshold that is less than said LED driving voltage.

15. The method of claim 11, further comprising:

a) generating a control voltage signal representative of said conduction angle of said silicon-controlled dimmer in accordance with one of said DC bus voltage and said drive current flowing through said LED load;

b) comparing said control voltage signal against a first reference signal representative of an angle threshold to generate a first comparison signal;

c) determining a turn-on time of said silicon-controlled dimmer in accordance with said DC bus voltage; and d) drawing said bleeder current when said first comparison signal is active and after said silicon-controlled dimmer is turned on until said DC bus voltage decreases to a first voltage threshold.

16. The apparatus of claim 1, wherein a beginning moment of said bleeder current is not earlier than a moment that said silicon-controlled dimmer is turned on from an off state, and an end moment of said bleeder current is not later than a moment that said DC bus voltage decreases to a first voltage threshold that is less than said LED driving voltage.

17. The apparatus of claim 6, wherein said control voltage signal is generated in accordance with a time length when said drive current flowing through said LED load is greater than a reference signal or when said DC bus voltage is greater than a voltage threshold.

18. The apparatus of claim 6, wherein said control voltage signal is compared against a first reference signal representative of an angle threshold to generate a first comparison signal.

19. The apparatus of claim 7, wherein said set signal generating circuit is configured to determine said turn-on moment of said silicon-controlled dimmer in accordance with comparisons between said DC bus voltage and a first voltage threshold, and between said DC bus voltage and a second voltage threshold.

* * * * *